US007144330B2

(12) United States Patent
Wade

(10) Patent No.: US 7,144,330 B2
(45) Date of Patent: Dec. 5, 2006

(54) OFFSET GOLF CLUB SET AND METHOD FOR FABRICATION

(76) Inventor: George Wade, 1600 W. Struck, Orange, CA (US) 92867

( * ) Notice: Subject to any disclaimer, the term of this patent is extended or adjusted under 35 U.S.C. 154(b) by 457 days.

(21) Appl. No.: 10/192,325

(22) Filed: Jul. 8, 2002

(65) Prior Publication Data

US 2003/0050130 A1 Mar. 13, 2003

Related U.S. Application Data

(60) Provisional application No. 60/304,591, filed on Jul. 9, 2001.

(51) Int. Cl.
*A63B 53/00* (2006.01)

(52) U.S. Cl. ..... 473/287; 473/314; 473/316

(58) Field of Classification Search ..... 473/287, 473/314, 316, 288, 289, 290, 291
See application file for complete search history.

(56) References Cited

U.S. PATENT DOCUMENTS 807,224 A 12/1905 Vaile
D216,031 S 11/1969 Blake
4,063,733 A 12/1977 Benedict
4,163,554 A 8/1979 Bernhardt
4,240,631 A * 12/1980 MacDougall ..... 473/289
4,265,451 A 5/1981 Bernhardt
4,795,153 A 1/1989 Thomas
5,333,862 A 8/1994 Teramoto
D359,331 S 6/1995 Fenton, Jr.
5,462,279 A 10/1995 Culpepper
D364,666 S 11/1995 Nagy
5,465,959 A 11/1995 Cheng
5,542,666 A * 8/1996 Chou ..... 473/314
5,616,087 A 4/1997 Bothwell
5,643,102 A * 7/1997 Hsien ..... 473/290
5,792,002 A 8/1998 Bothwell
5,931,741 A * 8/1999 Fenton, Jr. ..... 473/305

OTHER PUBLICATIONS

PCT Int Search Rpt, Oct. 3, 2002, Wade.

* cited by examiner

*Primary Examiner*—Stephen Blau
(74) *Attorney, Agent, or Firm*—Randall L. Reed

(57) ABSTRACT

A set of golf clubs is provided with shafts that have a bend formed by three shaft segments. The second shaft segment connects the first and third shaft segments and offsets the third shaft segment from the first shaft segment, wherein the third shaft segment is on a line parallel to a line extending along the first shaft segment. Shafts offset as described are attached to a set of golf club heads such that the offset shafts are positioned in a forward offset position in front of the impact surface of the golf club head with the degree of forward offset increasing with the increasing club number of the club heads of the set. The overall degree of offset can be increased or decreased based on the skill of the golfer using the clubs.

28 Claims, 6 Drawing Sheets

Fig. 7
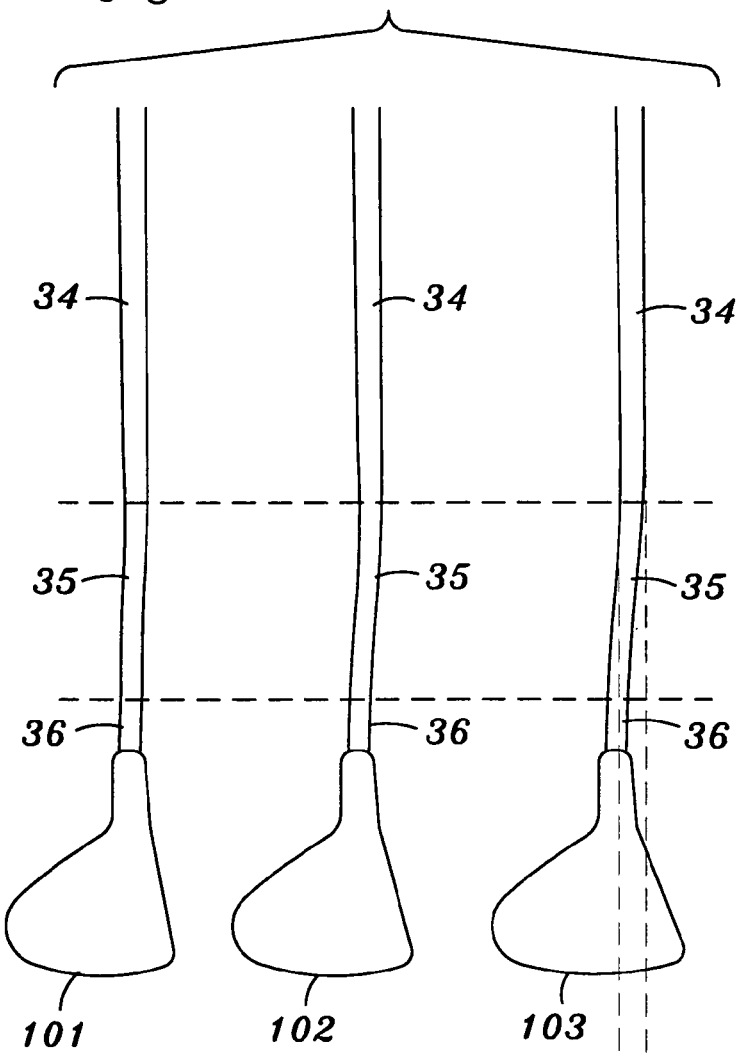
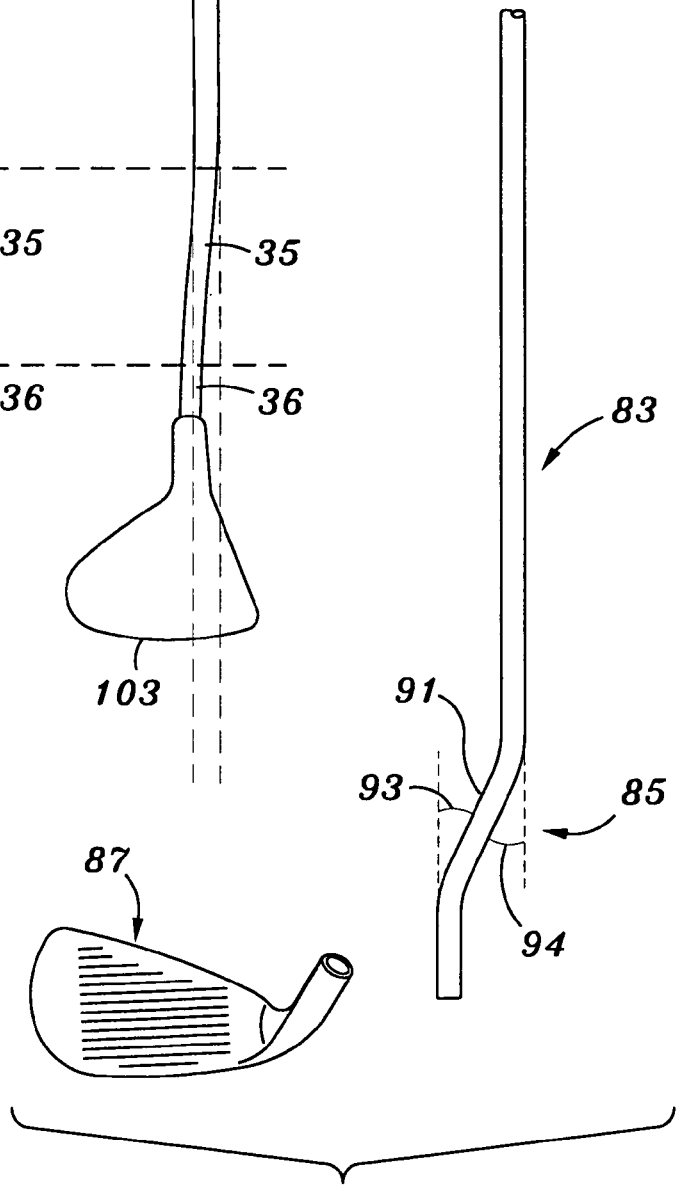
Fig. 6

OFFSET GOLF CLUB SET AND METHOD FOR FABRICATION

RELATED APPLICATIONS

The present application claims priority under 35 USC § 119 (e) form U.S. provisional application Ser. No. 60/304,591 filed Jul. 9, 2001 and entitled Offset Golf Club Set and Method for Fabrication.

FIELD OF THE INVENTION

The present invention relates to golf clubs and more particularly to a set of golf clubs with offset shafts and a method for fabricating the same.

BACKGROUND OF THE INVENTION

Offsetting the shaft of a golf club to increase performance of the club has been disclosed in U.S. Pat. No. 5,792,002 and reissue patent RE 38,717, by Bothwell, which is incorporated herein by reference and which are owned by the same entity that owns this specification. The invention described in those patents achieves this effect by offsetting the shaft of the club 21 (FIG. 1) by putting a bend in the shaft. The bend is created as depicted in FIG. 1 by projecting off of a first shaft segment 27 a second shaft segment 25 at a predefined angle 28 and having second shaft segment 25 attach to a third shaft segment 28 at the same predefined angle 26 such that the first and third shaft segments are in parallel alignment. The parallel alignment is illustrated by lines A and B that are extensions of the center axis of first 27 and third 23 shaft segments. Lines A and B being parallel to each other. Although this design was new and revolutionary it still did not provide a an adequate means for integrating it into a set of golf clubs to allow it to be adapted for use by a wide variety of golfers. There also was a need to develop an efficient and economical fabrication process.

The prior art also includes a significant number of putters that rely on some means of offsetting different shaft segments to change the position of the putter's hands. The prior art also has suggested putting the offset in the hosel of the golf club. However, the purpose and of doing this is different. Additionally, offsetting the hosel creates it own problems with the need for redesigning the club head and the manufacture of design specific club heads, which limit the use and complicate the manufacturing process. Thus, what is needed is a means of redesigning golf clubs to maximize the use of the offsetting of the shaft that can easily and quickly integrate into an efficient and effective manufacturing process.

SUMMARY

It is an objective of the present invention to provided a set of golf clubs that effectively and efficiently utilize the concept of offsetting the shaft of a golf club set to increase the effectiveness of a golfer. It is a further object to provide a means to economically and efficiently manufacture such a set of clubs.

The invention accomplishes this and other objectives by providing a set of golf clubs with offset shafts in which each club of the set has: a golf club head with a substantially planar golf ball engaging surface; a golf club shaft with: a first shaft segment attached to and extending up from said golf club head along a first imaginary line, to a first bend; a second shaft segment extending off at said first bend from said first shaft segment at a first predetermined angle of divergence to a second bend; a third shaft segment extending, along a second imaginary line, off at said second bend from said second shaft segment at a second predefined angle of divergence; wherein said first imaginary line of said first shaft segment is parallel to said second imaginary line of said third shaft segment and said golf club shaft is positioned with respect to said golf club head such that an extension of said second imaginary line towards said golf club head projects to a position closer to a center of said golf club head than a projection of said first imaginary line towards said golf club head; and wherein for each club the second and third shaft segments are in a forward offset in a position forward of impact surface of that club; wherein the degree of forward offset for each club increases with increasing club number. Alternatively, the first line can project to a position on the ground that is closer to a golfer using the club than the second line.

In another aspect of the invention it provides a method for fabricating a set of golf clubs that includes the steps of: providing a standard shaft comprising the following: a first shaft segment capable of being attached at an end of said first shaft segment to a golf club head, and said shaft segment extends up along a first imaginary line, to a first bend; a second shaft segment extending off at said first bend from said first shaft segment at a first predetermined angle of divergence to a second bend; a third shaft segment extending, along a second imaginary line, off at said second bend from said second shaft segment at a second predefined angle of divergence; wherein said first imaginary line of said first shaft segment is parallel to said second imaginary line of said third shaft segment; and wherein said first and second predefined angles are equal and said second section is positioned at a predetermined divergent angle with respect to said first and third shaft segments; and attaching at least two standard shafts to at least two golf club heads of different club head number so that said standard shafts attached to each of the at least two golf club heads are in a forward offset position with the position of forward offset being progressively greater for a club heads of higher number.

BRIEF DESCRIPTION OF THE DRAWINGS

The invention will be better understood by an examination of the following description, together with the accompanying drawings, in which:

FIG. 6 depicts a standard shaft used in the preferred embodiment of the invention and a club head; and FIG. 7 is a front view of a set of woods made according to the present invention.

DETAILED DESCRIPTION OF THE PREFERRED EMBODIMENT

Figure 1:
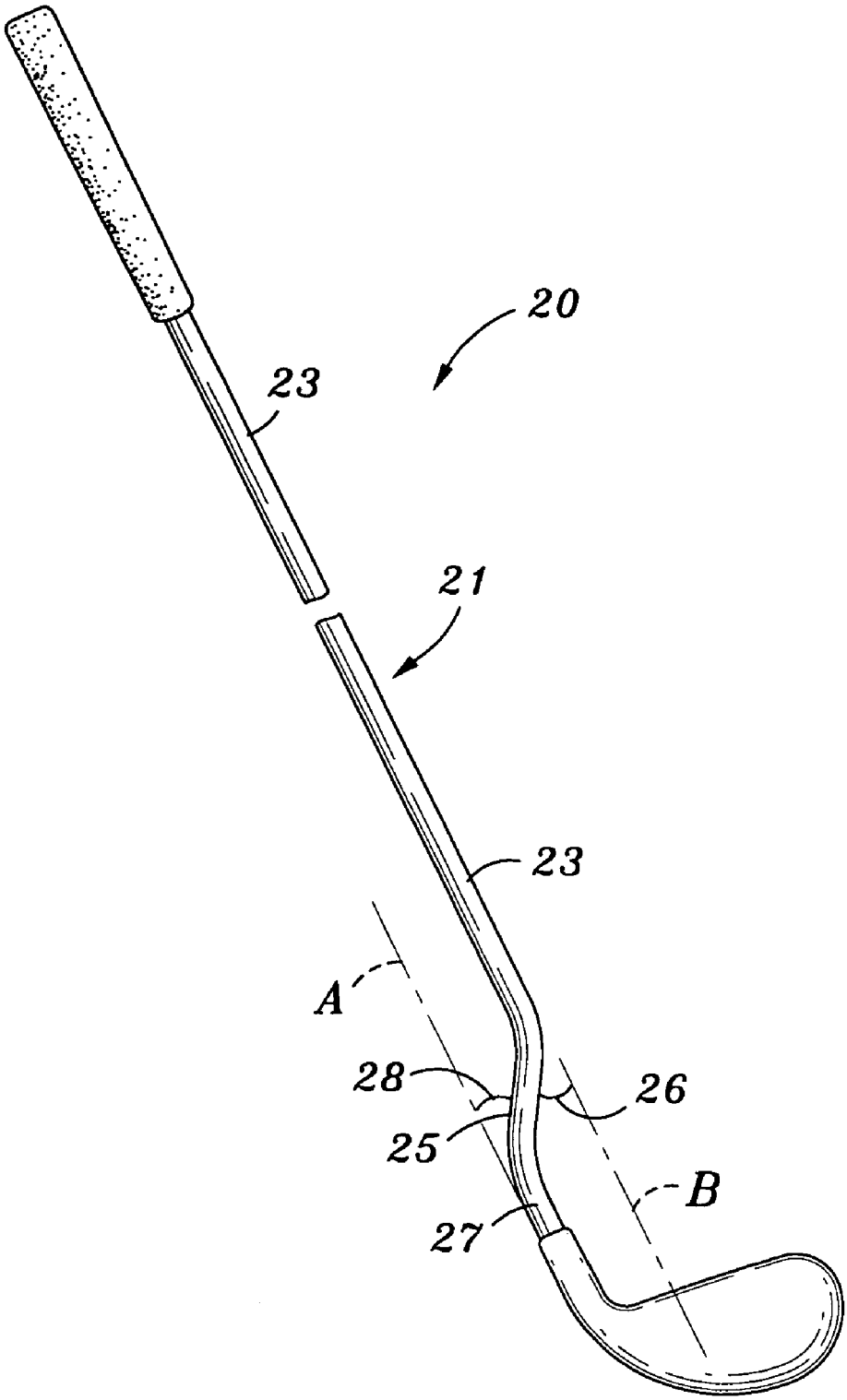
Fig. 1 (PRIOR ART)
FIG. 1 is a club with an offset shaft.
Figure 2A:
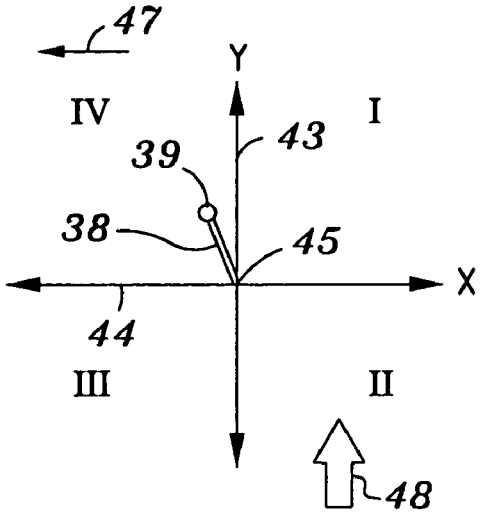
FIG. 2A is a schematic diagram that shows the angle of offset for a right-handed club.
Figure 2B:
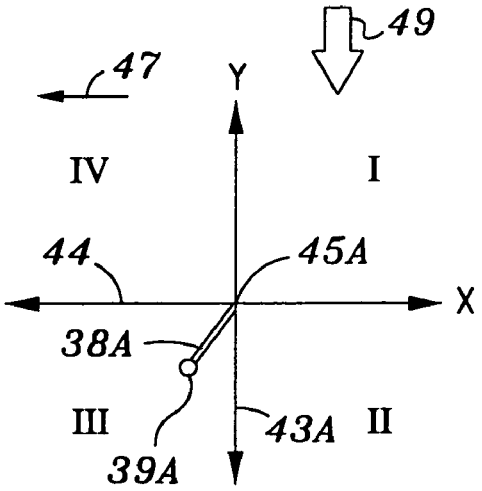
FIG. 2B is a schematic diagram that shows the angle of offset for a left-handed club.
Figure 2:
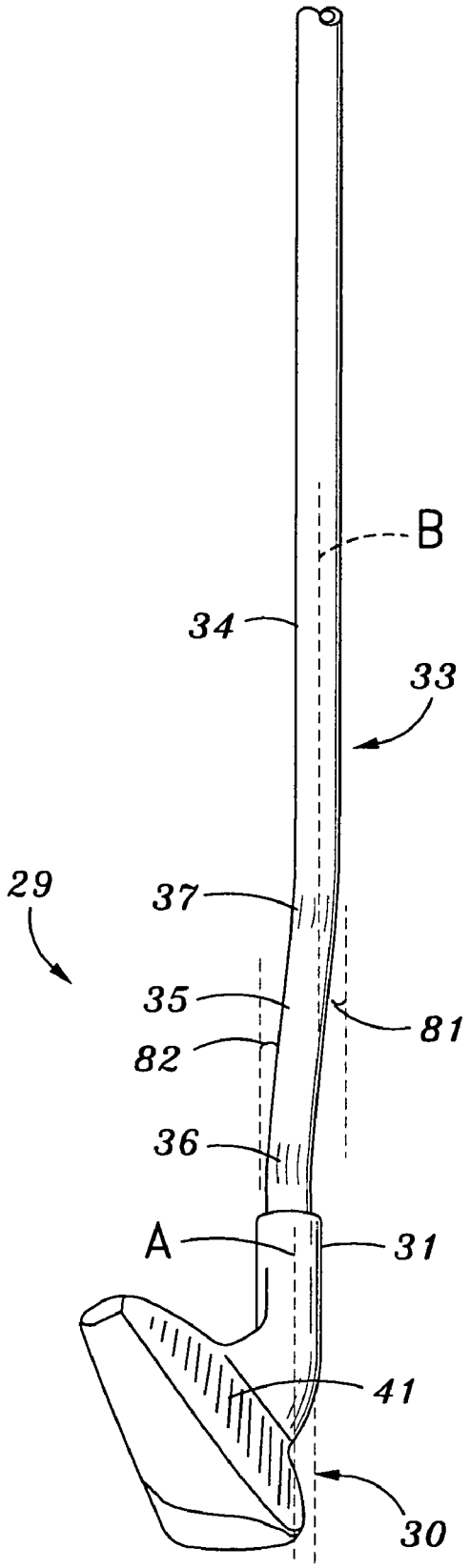
FIG. 2 depicts a front raised view of a club made according to the present invention.

FIG. 2 presents a front view of a seven iron 29 made according to the present invention. Club head 30 has its hosel 31 pointing up with the shaft 33 projecting out of the hosel 31. The third 34, second 35 and first 36 shaft sections of the golf club 29 can be seen. As depicted in FIG. 2 the bend formed by the juncture 37 of third shaft section 34 and second shaft section 35 and the bend 39 formed by second shaft section 35 and first 36 sections first shaft section are positioned in an offset position such that the juncture 37 of the third 36 and second 35 shafts sections is angled towards a point in front of the club head 30. The position of the third 34 and second 35 shaft sections being known herein as the forward offset position.

FIG. 2*a* a graph provides a schematic representation of the position of the bent shaft portion with respect to the face of the impact surface of the club head 30. The club being swung in a right to left direction along the x-axis in the direction of arrow 47 and a golfer using the club would be facing in the direction of arrow 48. In FIG. 2*a* the X-axis 44 is a two dimensional idealization of the swing plane of the golf club. The Y-axis extending upwards 43 is an idealization of the face of the club head with a direction of alignment of the face or hitting surface of the club head along the y-axis being in the onset position. The first shaft segment would project up from the origin 45 of the graph in FIG. 2A. Accordingly, when the second and third sections of the shaft are positioned in the forward offset position then the second section as depicted by line 38 projects out towards the left side of the Y-axis with the juncture of the second and third shaft section at point 37, the third shaft section in this idealization coming directly out of the graph at 37 in FIG. 2A in a position roughly or approximately perpendicular to the plane formed by the x and y axis. Forward offset thus being a position located in the upper left quadrant (quadrant IV) formed by the x and y axis in FIG. 2A.

Figure 3:
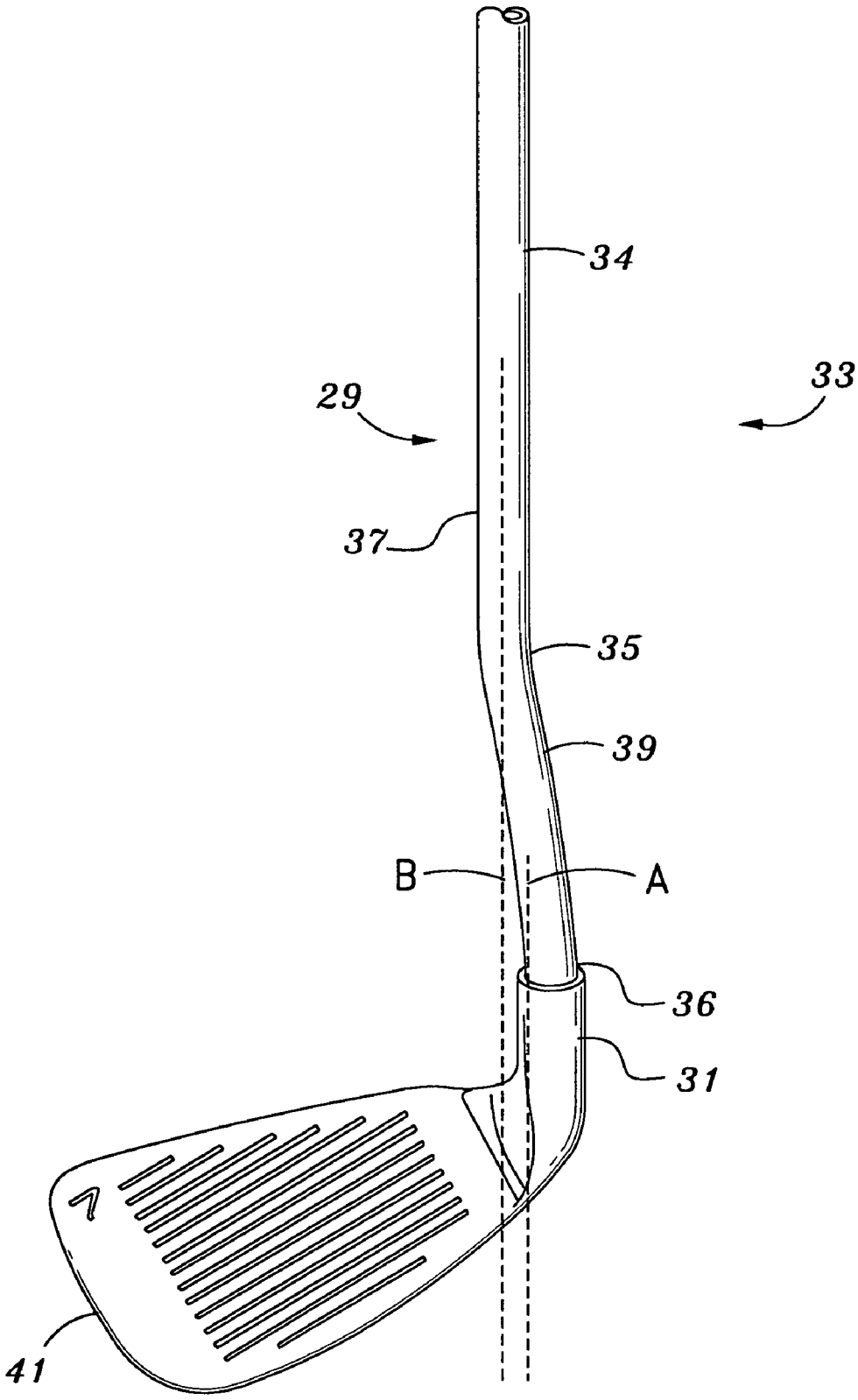
FIG. 3 is a raised view of the face a club with an offset shaft made according to the present invention.

FIG. 2A is a representation of a right-handed club. However, the invention described herein is just as applicable to a set of left-handed clubs. A left-handed club would be a mirror image of the right-handed club. FIG. 2B provides a schematic representation of the relative positions of the various shaft segments for a left-handed club. The swing plane of the club would still be along the x-axis in the direction of arrow 47 and a left-handed golfer using the club would be facing in the direction of arrow 49. The impact surface of the club would be along the lower section of the y-axis 43A. The first club shaft segment would project out of the origin 45A of the graph in FIG. 2B. The second club shaft segment 38A would project off of first club shaft segment into the lower left quadrant (quadrant III). The third shaft segment would project out of graph in FIG. 2B at point 39A FIG. 3 is a view of the face of the impact surface 41 of the seven iron 29 depicted in FIG. 2. This picture provides another perspective of the seven iron made according to the present invention, showing how the second section 35 and the juncture 37 of third 34 and second section 35 appear in their forward offset position in front of the impact surface 41 of the club. First imaginary line A extends along the center axis of first shaft segment 36 and secondary imaginary line B extends along the center axis of third shaft segment 34. Lines A and B are parallel. As can be seen in FIG. 3 the second imaginary line B is closer to the center of club head 41 than first imaginary line A.

For optimal effect it has been determined that the bend in the shaft should be offset slightly forward of the club head face as depicted and described above. It has been found that for even more optimal effect that the position of offset should be slightly increased for increasing club head number. Such as, the forward offset for the three club should be a little greater than for the two club. Correspondingly, the forward offset for the four club should be slightly more than for the three club and so on.

Figure 4:
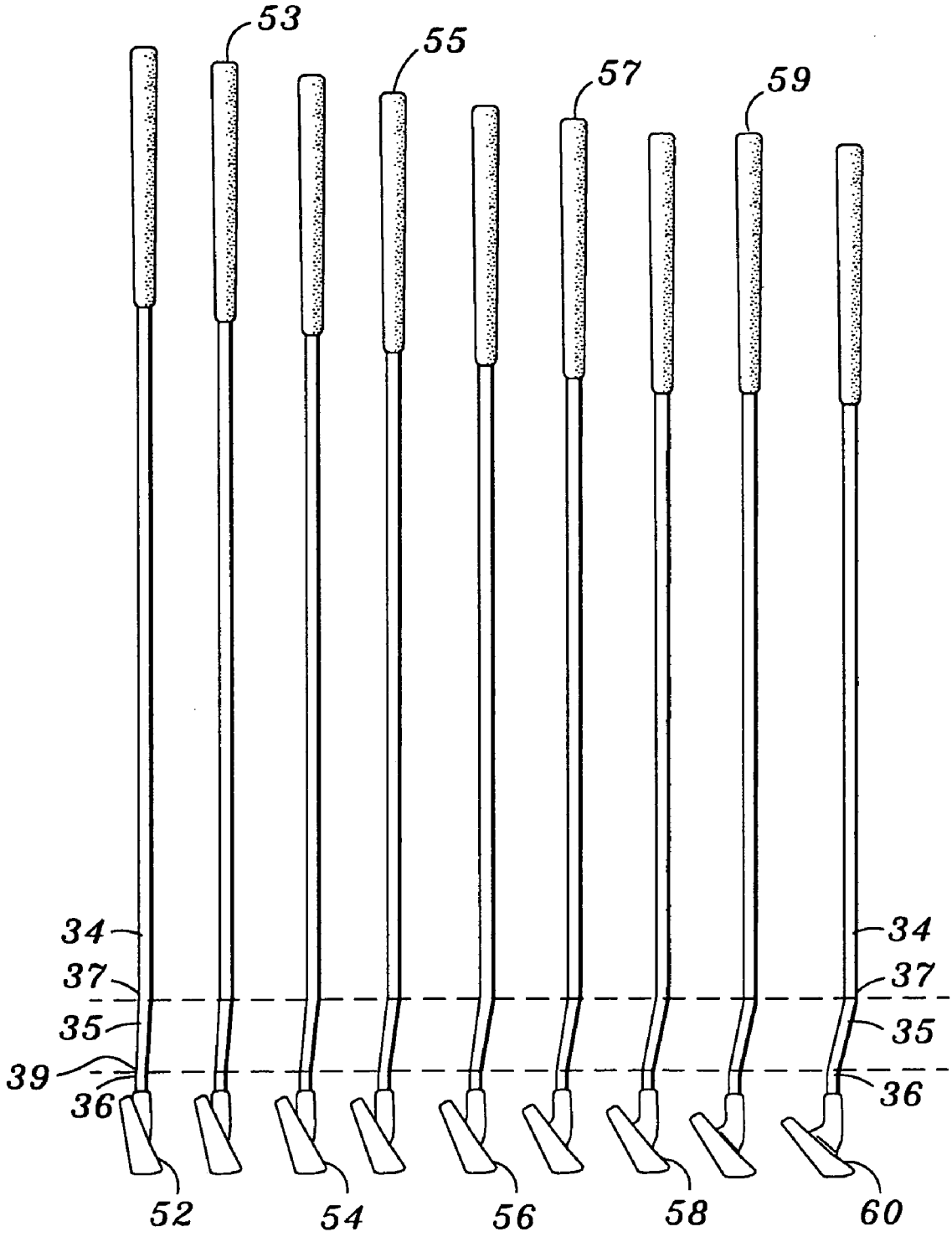
FIG. 4 is a front view a set of irons made according to the present invention.

FIG. 4 depicts a set of golf clubs made according to the practice of the present invention, specifically a set of irons. The set starts at club 52 a two iron with a very slight offset as depicted by the three shaft segments 36, 35 and 34. The offset then gradually increases with each club, i.e. three club 53, four club 54, five club 55, six club 56, seven club 57, eight club 58, nine club 59 and ending with sand wedge 60 which has the maximum offset. On the sand wedge 60 the third 34, second 35 and first 36 shaft sections can clearly be seen there as well as the juncture 37 of the third 34 and second 35 sections of the shaft 33 which projects out in front of the club head in the forward offset position. On the other hand the forward offset position of the second shaft of two club 52 is barely perceptible in FIG. 4. As you scan down the set of clubs from the two 52, to the three 53, four 54, five 55, six 56, seven 57, eight 58, nine 59 and finally to the sand wedge 60 the offset becomes more pronounced.

It has been found also that the degree of skill of the golfer will determine the actual range of offset required for the clubs that the player will be using. A skilled golfer does not need as wide a range of offset as a golfer with a high handicap.

Figure 5:
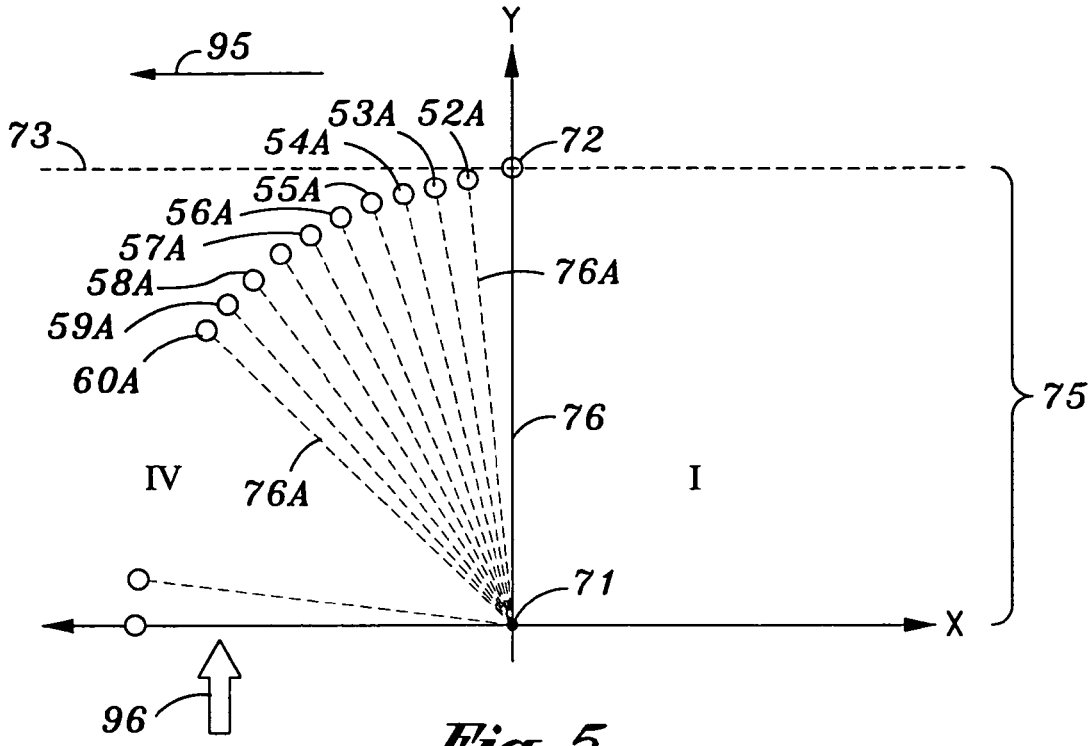
FIG. 5 is a schematic diagram showing the progression of offset of a set of right-handed clubs made according to a preferred embodiment of the present invention.

FIG. 5 presents two-dimensional depiction, which is not to scale, of an arrangement of offset for a set of clubs made for one preferred embodiment of the present invention. The X-axis is the swing plane of the golf club (the swing being in a right to left direction) in the direction of arrow 95 and the Y-axis is the plane of the impact surface of the club head that is normally at 90 degrees to the swing plane. Arrow 96 shows the direction a right-handed golfer would be facing when using the club. 71 is the central axis of the first club shaft segment as it comes out of the hosel and dotted line 73 is a line parallel to the X-axis and 0.625 of an inch from the X-axis, this would be along perpendicular distance 75 along the direction of the Y-axis. In a preferred embodiment the front edge of the third shaft section for each club, as the number of the club head increases would be positioned closer to the X-axis as measured along the vertical distance of the Y-axis. Consequently, the offset position of the two club 52 would place the front edge of the third shaft segment at a point 52A about 0.600 of an inch from the X-axis as measured along the vertical distance of the Y-axis. For each successive club the front edge of the third shaft segment of portion will be 0.032 of an inch closer to the X-axis (three club 53A, four club 54A, five club 55A, six club 56A, seven club 57A, the eight club 58A and nine club 59A) all the way up to the sand wedge that might be positioned at 0.312 of an inch from the X-axis. This is just one example and the distances and angle of offset can be significantly varied without departing from the principals of the present invention.

Although the above description should be clear, another way to describe FIG. 5 is to realize that line 76, the positive portion of the y-axis, passes through the onset position 72.

The onset position being that position where a plane formed by the first, second and third club shaft segments is orthogonal to the swing plane of the golf club. The plane of the first, second and third club shaft segments at onset running along the y-axis in FIG. 5. Thus, as you move the shaft to each progressive offset position between 52 to 60 you are in fact moving the plane formed by the first, second and third club shaft segments to each of these positions as indicted by dashed lines running from 71 out to each progressive offset position 52A to 60A. The dotted lines indicating the plane of the first, second and third shaft segments starting at 76A and ending at 76H.

Figure 5A:
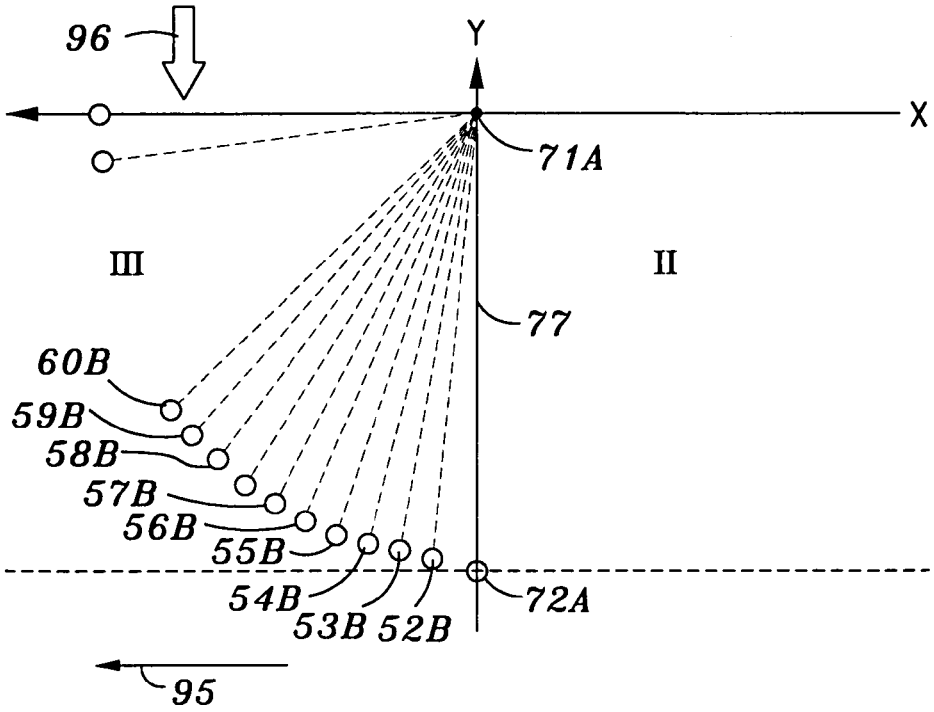
FIG. 5A is a schematic diagram showing the progression of offset of a set of left-handed clubs made according to a preferred embodiment of the present invention.

As noted above the invention could be used with left-handed golf clubs. FIG. 5A, provides a schematic diagram how the offset of clubs in a set of left-handed clubs would appear. 52B being a two iron, 53B being a three iron, 54B being a four iron, 55B being a five iron, 56B being a six iron, 57B being a seven iron, 58B being eight iron, 59B being a nine iron and 60B being a pitching wedge. It would be similar for other clubs. The x-axis being the swing plane and arrow 95 is the direction of the swing of the club. Arrow 97 shows the direction a left-handed gofer using the clubs would be facing. The onset point would thus be at 72A for a left-handed club.

Likewise, another way to describe FIG. 5A for a left-handed gofler is to realize that line 77, the negative portion of the y-axis, passes through the onset position 72A. The onset position being that position where a plane formed by the first, second and third club shaft segments is orthogonal to the swing plane of the golf club. The plane 77 of the first, second and third club shaft segments at onset running along the y-axis in FIG. 5A. Thus, as you move the shaft to each progressive offset position between 52B to 60B you are in fact moving the plane formed by the first, second and third club shaft segments to each of these positions as indicted by dashed lines running from 71A out to each progressive offset position 52B to 60B. The dotted lines indicating the plane of the first, second and third shaft segments starting at 77A and ending at 77H.

It has been determined that in a preferred embodiment the length of the second shaft segment only needs to be about two to three inches and the predefined angles 81 and 82 (FIG. 2) at which the second shaft segment is placed does not have to be more than three to ten degrees. Even more important, it has been found that the size of the second shaft segment and the predefined angles can be fix and used with all of the clubs of a set of golf clubs. Thus one shaft configuration 83 (FIG. 6) with the required bend 85 in it can be used for all of the clubs of a set of golf clubs. Thus, all of the club heads 87 from a fairway wood to the sand wedge and pitching wedge can use the same shaft configuration, i.e. one with the same second segment 91 length and the same preset angles 93 and 94 which are equal. Consequently, one preset shaft model with a predetermined bend in it can be used to fabricate a complete set of golf clubs with the one standard shaft. Naturally, the length of each shaft 83 will be cut to make it the right length for the club head being used. For instance a fairway wood would have a longer shaft than a two iron and likewise a two iron would have a longer shaft than a nine iron. The shaft for each club is merely positioned with the appropriate off set and then cut to the right length and the handle is placed on the shaft. Although the above dimensions and configurations described a preferred embodiment these aspects of the invention can be varied significantly without departing from the concepts of the present invention.

Attempting to incorporate the bend into the hosel of each club would require a specially made club for each club of a set of golf clubs. Putting the bend in the hosel would also tend to move the large shank formed by the hosel towards the point of impact on the golf club head surface and tend to cause more shanked balls. As noted above the present invention avoids this problem by putting the bend in the shaft and thus allows for the attaching of a shaft with a standard bend on a progressively offset fashion. This could also allow the retrofitting a set of bent shafts with progressive offset on to the heads of and existing set of club heads.

FIG. 7 shows the concept of the present invention applied to a set of fairway woods a driver 101, a two wood 102 and a three wood 103.

According to mechanical analysis, when a ball is struck, the force of impact produces a twisting force or torque. The golfers hands resist this torque and the energy is dissipated in the hands. Another problem that golfers, especially high handicap or inexperienced golfers, have is setting up properly such that their hands are little in front of the ball just before beginning their back swing. One of the unique features of a set of clubs made according to the present invention is the fact that the offset of the shaft forward of the club head automatically positions the golfers hands in front of the ball and club head. Additionally, by putting the golfers hands in towards the club head at the onset position and slightly forward of the club head and ball at the offset position reduces the torque experienced when hitting the golf ball and thus increasing the moment of inertia. This is particularly important when using fairway woods or the lower iron numbers. By moving the hands more towards the center of gravity of the club head, i.e. to the onset position it reduces the torque.

While the invention has been particularly shown and described with reference to a preferred embodiment thereof, it will be understood by those skilled in the art that various changes in form and detail may be made to it without departing from the spirit and scope of the invention.

I claim:

1. A set of golf clubs with offset shafts comprising:

a set of golf clubs each club of said set having:

a golf club head with a substantially planar golf ball engaging surface and a hosel;

a golf club shaft with:

a first shaft segment attached to and extending up from said hosel of said golf club head along a first imaginary line, to a first bend;

a second shaft segment extending off at said first bend from said first shaft segment at a first predetermined angle of divergence to a second bend;

a third shaft segment extending, along a second imaginary line, off at said second bend from said second shaft segment at a second predefined angle of divergence;

wherein said first imaginary line of said first shaft segment is parallel to said second imaginary line of said third shaft segment and said golf club shaft is positioned with respect to said golf club head such that an extension of said second imaginary line towards said golf club head projects to a position closer to a center of said golf club head than a projection of said first imaginary line towards said golf club head; and wherein for each club the second and third shaft segments are in a forward offset in a position forward of an impact surface of said club;

wherein the degree of forward offset for each club increases with increasing club number.

2. The golf club set of claim 1 wherein the degree of forward offset of each club of said set is measured from a line perpendicular to the swing plane of each club said line passing through a point of onset and each club being at least 0.032 of an inch from said line with each club as the club head number increases being progressively 0.032 an inch further way from said line.

3. The golf club set of claim 1 wherein each club has a shaft made from a standard shaft model with said first, second and third shaft segments.

4. The golf club set of claim 1 wherein said set of golf clubs comprises at least two clubs.

5. The golf club set of claim 4 comprising a two, three, four, five, six, seven and nine irons.

6. The golf club set of claim 5 further comprising a sand wedge and pitching wedge.

7. The golf club set of claim 1 comprising a driver, a two-fairway wood and a three-fairway wood.

8. The golf club set of claim 1 wherein the degree of forward offset of each club is based on the skill level of a person who will use said set.

9. The golf club set of claim 8 wherein the overall degree of forward offset is increased for the decreasing skill level of the person using the set.

10. A set of golf clubs with offset shafts comprising:

each club of the set having:

a golf club head with a substantially planar golf ball engaging surface;

a golf club shaft with:

a first shaft segment attached to and extending up from said golf club head along a first imaginary Line, to a first bend;

a second shaft segment extending off at said first bend from said first shaft segment at a first predetermined angle of divergence to a second bend;

a third shaft segment extending, along a second imaginary line, off at said second bend from said second shaft segment at a second predefined angle of divergence;

wherein said first imaginary line of said first shaft segment is parallel to said second imaginary line of said third shaft segment and said golf club shaft is positioned with respect to said golf club head such that an extension of said second imaginary line towards said golf club head projects to a position further away from a golfer holding the club in a position to hit a ball than a projection of said first imaginary line towards said golf club head; and wherein for each club the second and third shaft segments are in a forward offset in a position forward of impact surface of that club;

wherein said angle of offset is defined by a plane formed by the first, second and third shaft segment with respect to a plane formed by a plane orthogonal to the swing plane of the golf club, which orthogonal plane is congruent with said first shaft segment; and wherein the degree of forward offset for each club increases with increasing club number.

11. The golf club set of claim 10 wherein the degree of forward offset of each club of the set is measured from a line parallel to the swing plane of each club said line passing through a point of onset and each club being at least 32 hundreds of an inch from said line with each club as the club head number increases being progressively 32 hundreds of an inch further way from said line and thus progressively 32 hundreds of an inch closer to the swing plane of said club.

12. The golf club set of claim 10 wherein each club has a shaft made from a standard shaft model with said first, second and third shaft segments.

13. The golf club set of claim 12 comprising a two, three, four, five, six, seven and nine.

14. The golf club set of claim 12 comprising a driver, a two-fairway wood and a three-fairway wood.

15. The golf club set of claim 10 wherein the club set comprises at least two clubs.

16. The golf club set of claim 15 further comprising a sand wedge and pitching wedge.

17. The golf club set of claim 10 wherein the degree of forward offset is based on the skill level of a person who will use the set.

18. The golf club set of claim 17 wherein the overall degree of forward offset is increased for the decreasing skill level of the person using the set.

19. A set of golf clubs with offset shafts comprising:

each club of the set having:

a golf club head with a substantially planar golf ball engaging surface with a hosel;

a golf club shaft with:

a first shaft segment attached to and extending up from said hosel of said golf club head along a first imaginary line, to a first bend;

a second shaft segment extending off at said first bend from said first shaft segment at a first predetermined angle of divergence to a second bend;

a third shaft segment extending, along a second imaginary line, off at said second bend from said second shaft segment at a second predefined angle of divergence; and wherein for each club the second and third shaft segments are in a forward offset in a position forward of an impact surface of that club;

wherein said angle of offset is defined by a plane formed by the first, second and third shaft segment with respect to a plane formed by a plane orthogonal to the swing plane of the golf club, which orthogonal plane is congruent with said first shaft segment; and wherein the degree of forward offset for each club increases with increasing club number.

20. The golf club set of claim 19 wherein the degree of forward offset of each club of the set is measured from a line parallel to the swing plane of each club said line passing through a point of onset and each club being at least 32 hundreds of an inch from said line with each club as the club head number increases being progressively 32 hundreds of an inch further way from said line and thus progressively 32 hundreds of an inch closer to the swing plane of said club.

21. The golf club set of claim 19 wherein each club has a shaft made from a standard shaft model with said first, second and third shaft segments.

22. The golf club set of claim 19 wherein the club set comprises at least two clubs.

23. The golf club set of claim 22 comprising a two, three, four, five, six, seven and nine.

24. The golf club set of claim 23 further comprising a sand wedge and pitching wedge.

25. The golf club set of claim 22 comprising a driver, a two-fairway wood and a three-fairway wood.

26. The golf club set of claim 19 wherein the degree of forward offset is based on the skill level of a person who will use the set.

27. The golf club set of claim 26 wherein the overall degree of forward offset is increased for the decreasing skill level of the person using the set.

28. The golf club set of claim 19 in which one club is positioned in a forward offset position such that a plane formed by said first, second and third club shaft segment is parallel to the swing plane of that golf club.

* * * * *